United States Patent [19]

Erickson et al.

[11] Patent Number: 4,993,188

[45] Date of Patent: Feb. 19, 1991

[54] SINGLE HUNG WINDOW JAMBLINER

[75] Inventors: Steven E. Erickson; Craig A. Anderson, both of Lincoln, Nebr.

[73] Assignee: SealRite Windows, Inc., Lincoln, Nebr.

[21] Appl. No.: 315,784

[22] Filed: Apr. 17, 1989

[51] Int. Cl.[5] ..... E05D 13/00; E06B 7/16; E06B 1/04

[52] U.S. Cl. ..... 49/419; 49/454; 52/207

[58] Field of Search ..... 52/207; 49/417, 418, 49/419, 181, 454

[56] References Cited

U.S. PATENT DOCUMENTS

| | | | |
|---|---|---|---|
| 2,157,426 | 5/1939 | Nelson | 49/419 |
| 3,256,641 | 6/1966 | Johnson | 49/419 |
| 3,336,698 | 8/1967 | MacGregor | 49/419 X |

FOREIGN PATENT DOCUMENTS

| | | | |
|---|---|---|---|
| 248761 | 12/1962 | Australia | 49/419 |
| 1025833 | 4/1966 | United Kingdom | 49/419 |

*Primary Examiner*—David A. Scherbel
*Assistant Examiner*—Deborah McGann Ripley
*Attorney, Agent, or Firm*—Zarley, McKee, Thomte, Voorhees & Sease

[57] ABSTRACT

A single hung window jamblinder is utilized in combination with a window frame having a pair of vertical jambs, the jambs having a vertical, generally T-shaped pocket therein. The jambliner includes an elongated channel member having a base portion and a pair of upstanding sides, and a pair of leg portions mounted on the channel member sides which will receive the stile of a sash and allow for slidable movement of the sash therealong. A resilient vinyl layer is secured along the channel base, and is wider than the channel base so as to protrude beyond each side of the base. The vinyl layer will have a width substantially equal to the width of the jamb pocket to retain the jambliner in position in the jamb. A resiliently compressible sponge-like pad is mounted on the vinyl layer, and is thick enough to bias the vinyl layer against the edges of the jamb pocket so as to prevent airflow between the jamb pocket and the exterior of the jamb.

5 Claims, 3 Drawing Sheets

SINGLE HUNG WINDOW JAMBLINER

TECHNICAL FIELD

The present invention relates generally to single hung windows, and more particularly to an improved single hung window jambliner which may be easily inserted within a window frame.

BACKGROUND OF THE INVENTION

Openings in walls to provide natural light, ventilation, or views, are classed as windows. The development of a movable sash, a system of one or more panes of glass in a movable frame of wood or metal, provided a means of ventilation as well as natural light. Each sash has a top and bottom rail and a pair of vertical side members called stiles, which hold one or more panes of glass within the sash. A double hung window consists of two sashes, one above the other, both of which slide vertically. A single hung window utilizes a fixed sash in conjunction with a slidable sash.

Conventional single hung windows are mounted in a window frame which is attached to the structural framing of the surrounding wall. A plastic cup is mounted to each vertical jamb of the window frame utilizing a series of spaced-apart screws or the like. A jambliner is then connected to the clip, and will receive the mechanical hardware and the sash. A layer of foam material biases the jambliner away from the clip and into a locked orientation.

One problem with the conventional method of installing a jambliner on a jamb is the amount of time required by a workman for the installation. Furthermore, the jambliner is not easily removable from the frame and thereby increases the amount of time and effort necessary to remove the sashes and jambliners during painting or staining of the window frame or sash.

A further problem with the prior art single hung windows which utilize jambliners mounted with screws to the jamb, is in the amount airflow allowed around the jambliner and window frame.

It is therefore a general object of the present invention to provide an improved single hung window with an easily removable sash and jambliner.

Another object of the present invention is to provide a jambliner for a single hung window which does not require the use of screws or the like to affix the jambliner to the jamb.

A further object of the present invention is to provide a jambliner and sash which may be installed by unskilled labor.

Still another object of the present invention is to provide a single hung window with a jambliner which greatly decreases the amount of time necessary for installation.

Still a further object is to provide a jambliner for a single hung window which greatly reduces the airflow rate in the connection of the jambliner to the jamb.

These and other objects of the present invention will be apparent to those skilled in the art.

SUMMARY OF THE INVENTION

The single hung window jambliner of the present invention is utilized in combination with a window frame having a pair of vertical jambs, the jambs having a vertical generally T-shaped pocket therein. The jambliner includes an elongated channel member having a base portion and a pair of upstanding sides, and a pair of leg portions mounted on the channel member sides which will receive the stile of a sash and allow for slidable movement of the sash therealong. A resilient vinyl layer is mounted along the channel base, and is wider than the channel base so as to protrude beyond each side of the base. The vinyl layer will have a width substantially equal to the width of the jamb pocket, but greater than the base, so as to protrude along each side of the base and be retained within the channel pocket. A resiliently compressible sponge-like pad is mounted on the vinyl layer, and is thick enough to bias the vinyl layer against the edges of the jamb pocket so as to prevent airflow between the jamb pocket and the exterior of the jamb.

DESCRIPTION OF THE PREFERRED EMBODIMENT

Figure 1:
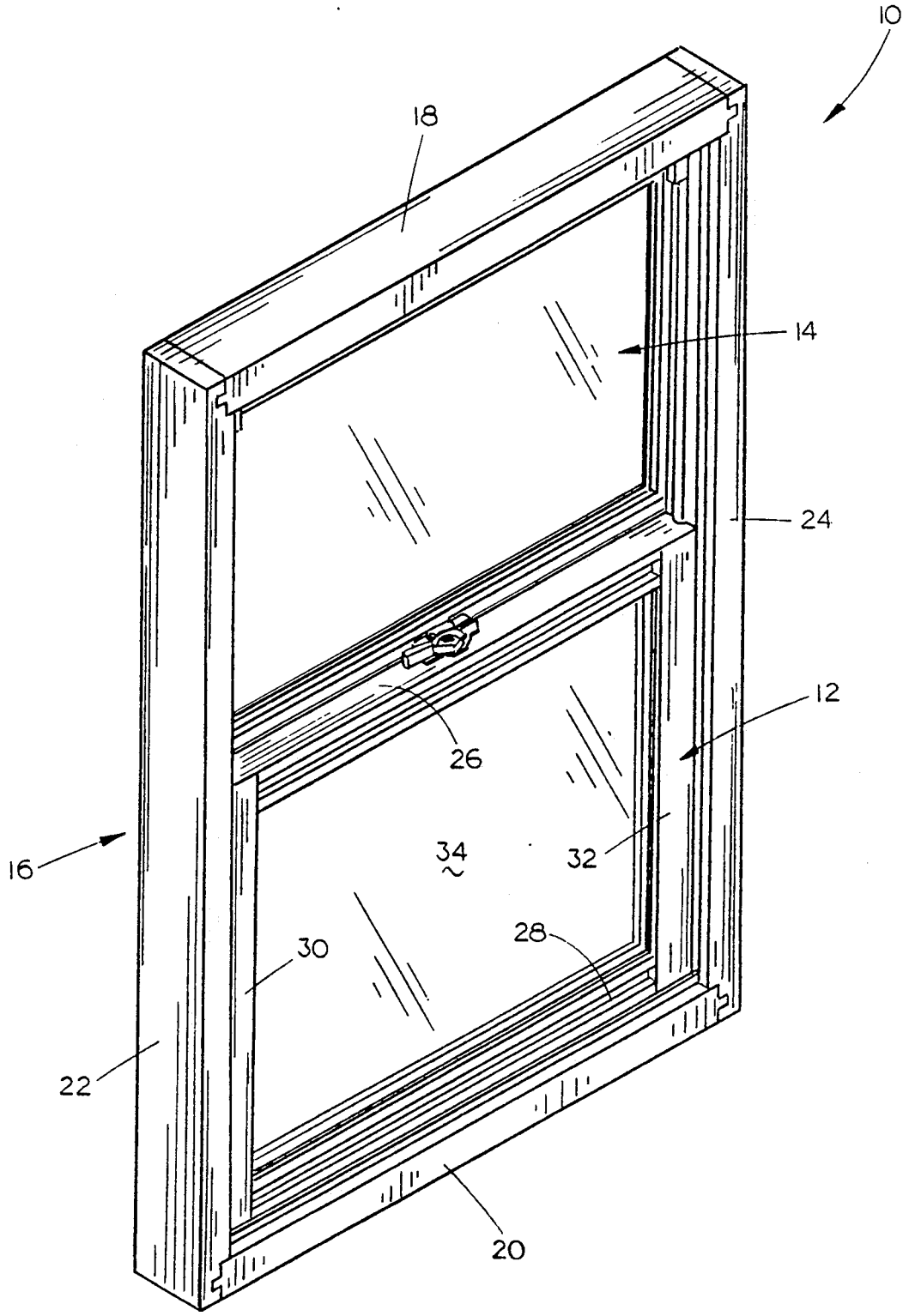
FIG. 1 is a perspective view of the single hung window of the present invention installed in a frame.

Referring now to the drawings, in which identical or corresponding parts are identified with the same reference numeral throughout the drawings, and more particularly to FIG. 1, the improved single hung window of the present invention is designated generally at 10 and includes a movable sash 12 and non-movable sash 14 mounted within a window frame 16. Window frame 16 may be attached to the structural framing of a surrounding wall in a conventional manner.

Window frame 16 includes a head 18, sill 20 and left and right jambs 22 and 24, respectively. Movable sash 12 is comprised of an upper rail 26, lower rail 28 and left and right stiles 30 and 32, with a pane of glass 34 mounted therebetween.

Figure 2:
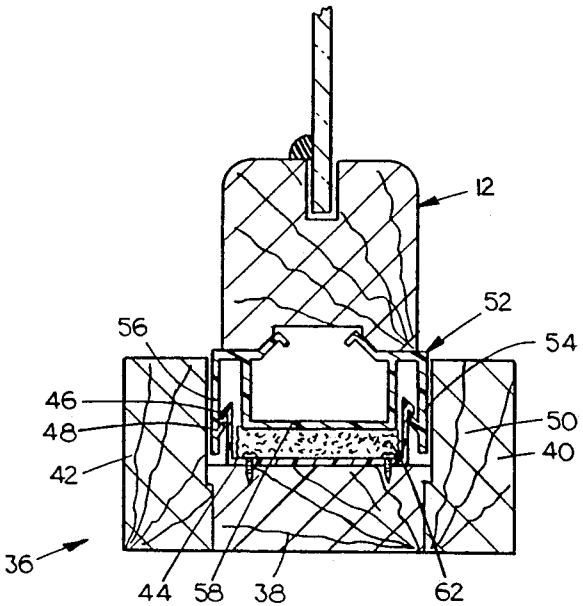
FIG. 2 (PRIOR ART)
FIG. 2 is a sectional view of a prior art jamb and jambliner.
Figure 6:
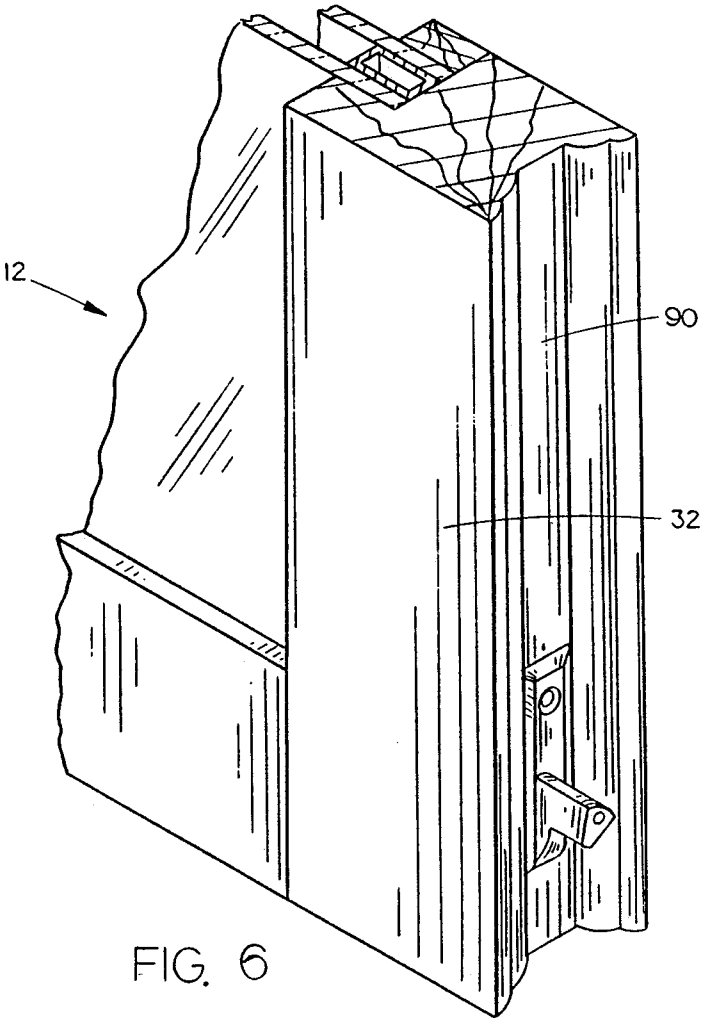
FIG. 6 is a perspective sectional view of a portion of the stile and bottom rail of a sash of the present invention.

Referring now to FIG. 2, the construction of a prior art jamb is designated generally at 36 and includes a jamb 38 having an interior lining 40 affixed along one vertical edge, and a exteriorly mounted blind stop 42 affixed along the opposite vertical edge thereof. Interior lining 40 and blind stop 42 are mounted to jamb 38 to form a vertical channel which will receive a jambliner and clip to mount the window sash. A channel-shaped plastic clip 44 is mounted to jamb 38 with a pair of legs projecting toward sash 12. An angular lip 46 on the end of each leg will lock onto a similar lip on the jambliner, as shown in the drawings. A conventional jambliner 52 has a pair of legs 54 and 56 with an angular lip 48 at the ends thereof designed to lock with lips 46 on clip 44. A layer of foam 62 is interposed between jambliner 52 and clip 44 to bias the jambliner outwardly into locking relation with clip 44.

Figure 3:
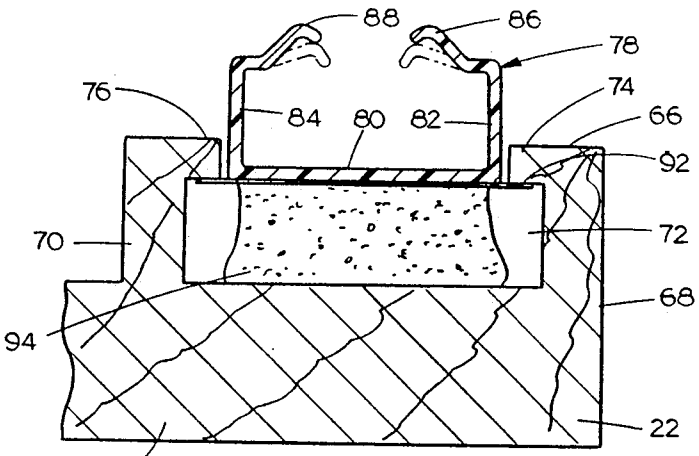
FIG. 3 is a sectional view of the jamb and jambliner of the present invention.
Figure 4:
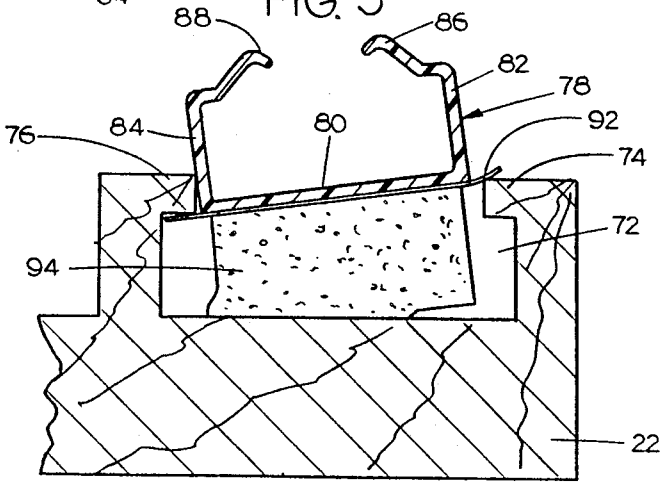
FIG. 4 is a sectional view of the jamb and jambliner of the present invention, showing the method of installing the liner in the jamb.
Figure 5:
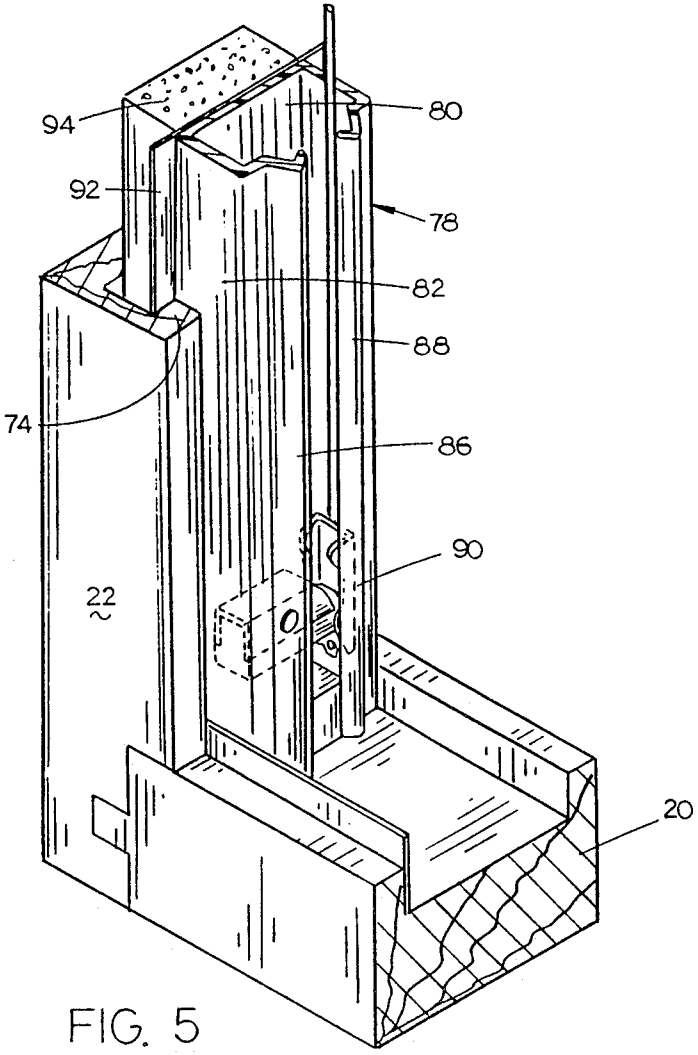
FIG. 5 is a perspective sectional view of a portion of the jamb and sill of the present invention.

Jamb 22 of the present invention, as shown in FIGS. 3-5, is preferably a single board which is joined to sill 20 in a conventional fashion. For purposes of description, jamb 22 will be described as having a rearward face 64, which will be mounted to the surrounding structure of the wall, an inner face 66 directed inwardly toward the sash, an interior side 68 facing the interior of the structure and an exterior side 70 facing the exterior of the structure. A channel 72 is cut into the interior face 66 of jamb 22 and extends from top to bottom. Channel 72 is routed outwardly towards the interior and exterior sides of jamb 22 so as to form an interior and exterior lip 74 and 76 respectively along the entire vertical interior face 66 of the jamb. Thus, pocket 72 will have a generally "T-shaped" cross-section.

The jambliner of the present invention is designated generally at 78 and is generally in the shape of a rectangular channel having a base 80 opposing vertical sides 82 and 84 and a pair of outwardly angularly projecting legs 86 and 88 extending from sides 82 and 84 along their entire vertical edge. Legs 86 and 88 project at an angle so as to be received in the V-shaped plow 90 cut into stiles 30 or 32 of sash 12. FIG. 3 shows a broken line configuration of legs 86 and 88 which indicates the resiliency of the legs to allow for pivoting of the sash out of the jamb liner, as well as allow ease of sliding motion in moving the sash upwardly or downwardly along the jambliner 78. The pocket formed within jambliner 78 will house the mechanical balance assembly, designated generally at 91, which assist in raising the individual sash.

A stiff but resilient layer of vinyl material 92 is affixed to the back of base 80 of jambliner 78, and projects beyond sides 82 and 84, along the entire vertical extent thereof, as shown in the drawings. Vinyl layer 92 has a width substantially equal to the width of channel 72 and slightly greater than the distance between lips 74 and 76, such that the vertical edges of layer 92 will contact lips 74 and 76 to seal the connection between jambliner 78 and jamb 22. A resilient, sponge-like foam pad 94 is affixed to vinyl layer 92 and has a depth slightly greater than the depth of pocket 72 so as to bias vinyl layer 92 against lips 74 and 76. Because foam pad 94 is of a sponge-like material, jambliner 78 may be easily removed from pocket 72 by pushing on one leg 84 of the jambliner so as to compress one edge of pad 94 and simultaneously pulling outwardly on leg 82 to bend one edge of vinyl layer 92 past lip 74 and free it of pocket 72. The other edge of vinyl layer 92 may then be easily removed from pocket 72. Similarly, jambliner 78 may be easily installed within jamb 22 by merely pressing one leg of the jambliner into the pocket and compressing pad 94 and then pressing the opposite leg 82 of the jambliner into the pocket until the protruding edges of the vinyl layer bend past lips 74 and 76 (see FIG. 4). Once vinyl layer 92 enters pocket 72, it is biased towards lips 74 and 76 and held in place by the resilience of foam pad 94. In this fashion, airflow is sealed at each lip 76 and 74, so as to increase the thermal insulation value of the connection of jambliner 78 with jamb 22. Because of the resilient legs 86 and 88 of jambliner 78, sash 12 may be easily raised or lowered, the effort required being adjustable by increasing or decreasing the tension in the mechanical balance assembly 91.

Since the jambliner may be simply snapped into place within jamb 22, the time and effort required to install the window of this invention is greatly reduced. Furthermore, no screws or hardware is necessary to install the jambliner in the frame.

Whereas the invention has been shown and described in connection with the preferred embodiments thereof, it will be understood that many modifications, substitutions and additions may be made which are within the intended broad scope of the appended claims. For example, a variety of weights, block-and-tackle, or other counterbalancing mechanisms may be utilized in place of mechanical balance assembly 90. Likewise, the jamb liner may have various leg configurations which are associated with various channel cuts along the sash stiles.

Thus, there has been shown and described an improved single hung window which accomplishes at least all of the above stated objects.

We claim:

1. In combination, a window frame having a pair of vertical jambs and at least one slidable sash removably mounted therein, each said jamb having an inner face directed toward said sash, and an outer face mounted to a surrounding wall;

each said jamb including a vertically-extending pocket open along the inner face of the jamb for receiving a jambliner;

each said jamb having a pair of vertical lips adapted to form said pocket with a generally T-shaped cross-section;

a jambliner means removably mounted in each of said jamb pockets, comprising an elongated channel member having a base portion, a pair of opposite longitudinal sides extending therefrom, and a pair of resilient leg portions adapted for slidably receiving the sash;

a resilient, flexible material layer operatively secured to said jambliner means base and protruding beyond the longitudinal sides thereof, a resiliently compressible pad secured between said material layer and said jamb and adapted to fill the depth of the pocket and bias said material layer against the jamb lips to form a seal to prevent air movement.

2. The combination of claim 1, wherein said material layer is a thermally insulative material.

3. The combination of claim 1, wherein said compressible pad is secured to said material layer for operative movement therewith.

4. The combination of claim 1, wherein said material layer is a vinyl material.

5. A removable jambliner for use with a window frame having a pair of opposing jambs, each jamb having a vertical pocket formed therealong with a pair of opposing lips formed along the vertical length thereof to form said pocket with a generally T-shaped horizontal cross-section, comprising:

an elongated channel member having a base portion and a pair of upstanding sides;

leg portions mounted on said channel member sides adapted to receive a sash stile for slidable movement therealong;

a resilient material layer operatively secured to said channel base and protruding beyond said upstanding sides;

a resiliently compressible pad secured to said material layer and having a thickness so as to bias said material layer away from the jamb and against the lips of said pocket when said jambliner is mounted in the jamb, whereby a seal against air movement is formed by said material layer biased against said vertical lips.

* * * * *